US005285921A

United States Patent [19]

Lai

[11] Patent Number: 5,285,921

[45] Date of Patent: Feb. 15, 1994

[54] CONTAINER FOR SOLAR HEATER

[76] Inventor: Herman Lai, No. 25, Ta Chin St., Taichung, Taiwan

[21] Appl. No.: 2,565

[22] Filed: Jan. 11, 1993

[51] Int. Cl.[5] ..... B65D 90/00

[52] U.S. Cl. ..... 220/444; 220/501; 220/23.86; 220/601

[58] Field of Search ..... 220/444, 446, 447, 445, 220/430, 431, 432, 433, 501, 23.83, 601

[56] References Cited

U.S. PATENT DOCUMENTS 4,527,542 7/1985 Denton ..... 220/444
4,957,097 9/1990 Chevalier et al. ..... 220/444
5,042,697 8/1991 Nelson ..... 220/444
5,082,138 1/1992 McGarvey ..... 220/444
5,213,728 5/1993 Hickman ..... 220/444

*Primary Examiner*—Joseph Man-Fu Moy
*Attorney, Agent, or Firm*—Kirkpatrick & Lockhart

[57] ABSTRACT

A container for a solar heater includes two barrels received in a housing for containing liquid and a sealing material filled between the barrels and the housing so as to seal the barrel. A pair of couplers are oppositely engaged in the upper portion of the barrel, and a connector is connected between the barrels. The barrels are coupled together by clamping rings.

5 Claims, 3 Drawing Sheets

CONTAINER FOR SOLAR HEATER

BACKGROUND OF THE INVENTION

1. Field of the Invention

The present invention relates to a container, and more particularly to a container for a solar heater.

2. Description of the Prior Art

Typical solar heaters comprise a container having an inlet for introducing hot water from the solar heater into the container and an outlet for introducing water from the container to the solar heater. However, normally, the container is not sealed such that heat may be easily radiated from the hot water container within the container.

The present invention has arisen to mitigate and/or obviate the afore-described disadvantages of the conventional containers for solar heaters.

SUMMARY OF THE INVENTION

The primary objective of the present invention is to provide a container for a solar heater in which the container is well sealed such that the heat of the water contained in the container will not be easily radiated.

In accordance with one aspect of the invention, there is provided a container for a solar heater comprising a housing, at least one barrel received in the housing for containing liquid and including an upper portion and a lower portion, a sealing material filled between the barrel and the housing, and a pair of couplers oppositely engaged in the upper portion of the barrel, whereby, the barrel is well sealed.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
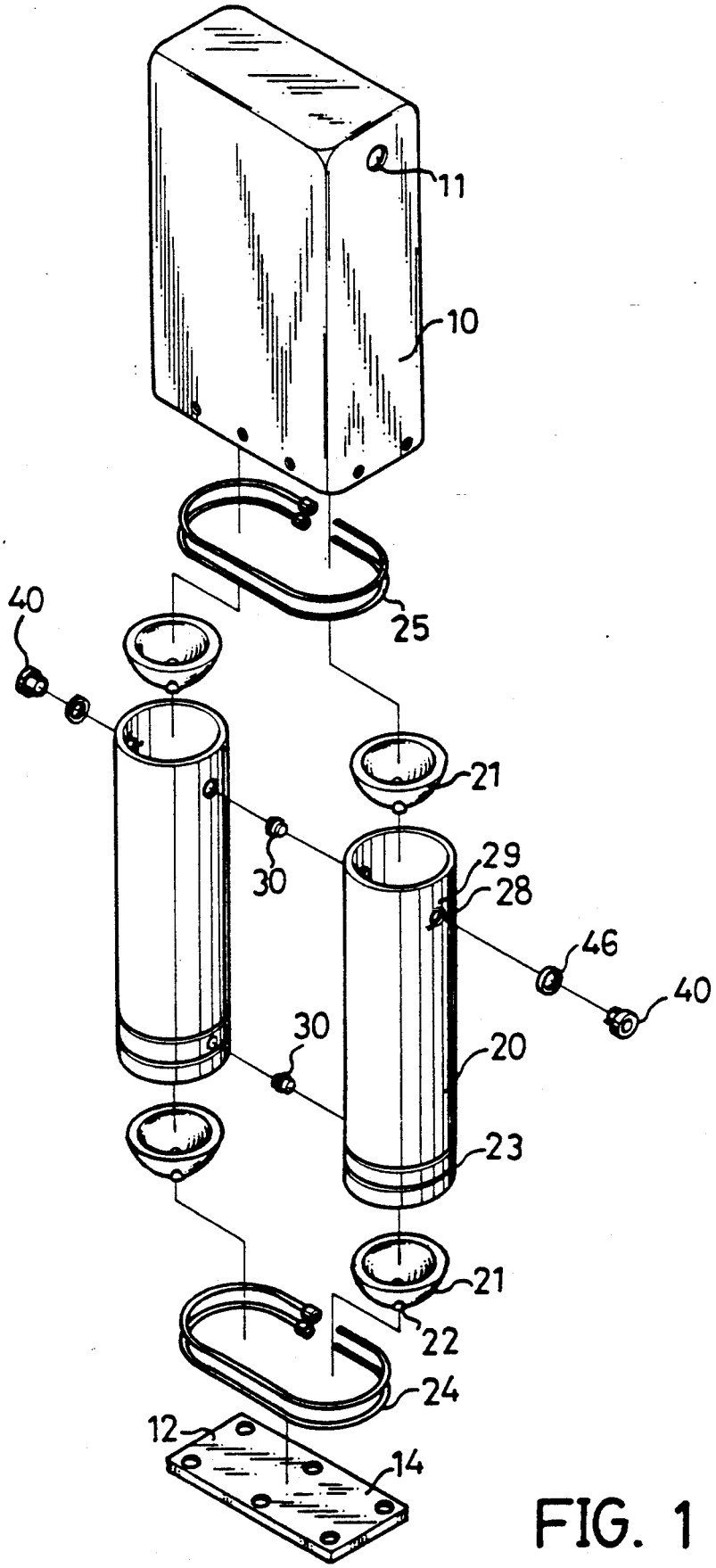
FIG. 1 is an exploded view of a container for a solar heater in accordance with the present invention.

Referring to the drawings, and initially to FIGS. to 3, a container for a solar heater in accordance with the present invention comprises a housing 10 including two holes 11 oppositely formed in the upper portion thereof and including an open bottom enclosed by a plate 12 which is secured to the housing 10 by screws, the plate 12 including a plurality of orifices 14 formed therein.

Two barrels 20 are received in the housing 10 and each includes a cap 21 fixed in the bottom portion and in the upper portion respectively by welding processes, each of the caps 21 includes at least one protrusion 22 formed therein for reinforcing the caps 21. Two annular grooves 23 are formed in the lower portion of each of the barrels 20, and a pair of clamping rings 24 are engaged with the annular grooves 23 for coupling the barrels 20 together. The upper portion of the barrels 20 are coupled together by another pair of clamping rings 25 which will be discuss hereinafter. A aperture 28 is formed in the upper portion of each of the barrels 20 and has three punctures 29 formed therearound. A space is formed between the housing 10 and the barrels 20, and a foamable materials 18 is injected into the space via the orifices 14 of the plate 12 such that the barrels 20 can be well sealed and such that the heat of the water contained within the barrels 20 will not be easily radiated.

Figure 5:
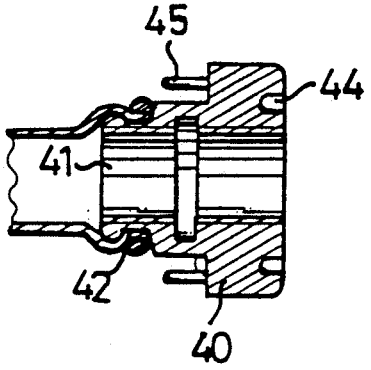
FIGS. 4 and 5 are cross sectional views illustrating the connectors and couplers.
Figure 4:
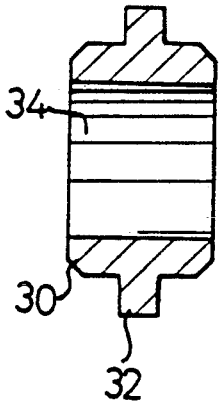

A pair of connectors 30 are connected between the barrels 20 and located in the upper portion and in the lower portion of the barrels 20 respectively, as shown in FIG. 4, each of the connectors 30 includes an annular rib 32 engaged between the barrels 20 and a bore 34 communicating the interiors of the barrels together, such that the water may flow from one of the barrels to the other barrel. A coupler 40 is engaged in the aperture 28 of each of the barrels 20, as shown in FIG. 5, each of the couplers 40, includes a bore 4 connecting the barrel 20 with the respective hole 11 of the housing 10, and includes three pins 45 force-fitted in the respective punctures 29 such that the couplers 40 can further be solidly secured to the barrels 20, and each of the couplers 40 includes an annular recess 42 formed therein, a hose 50 includes one end connected to the annular recess 42 of one of the couplers 40 and the other end extended toward the bottom portion of the barrel 20. A sealing ring 46 is preferably engaged between the coupler 40 and the barrel 20. Each of the couplers 40 includes two slots 44 formed therein for receiving the clamping rings 25 respectively, such that the couplers 40 can be solidly coupled to the barrels 20.

Figure 2:
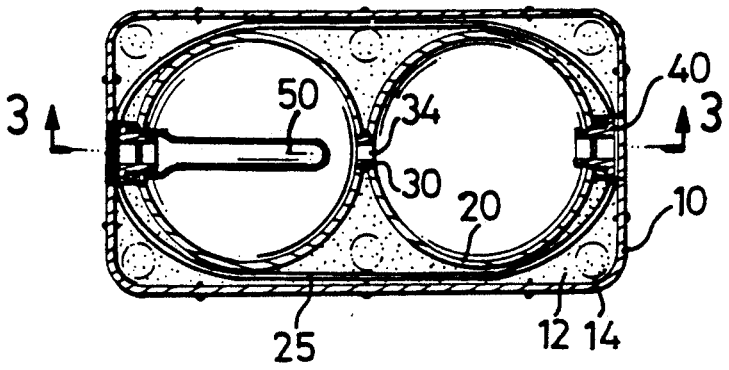
FIG. 2 is a cross sectional view taken along lines 2—2 of FIG. 3.

In operation, the water contained in the left barrel (FIGS. 2 and 3) is pumped out of the barrel 20 to the solar heater via the hose 50, and the water flowing through the solar heater may flow into the right barrel via the bore 41 of the coupler 40.

Figure 3:
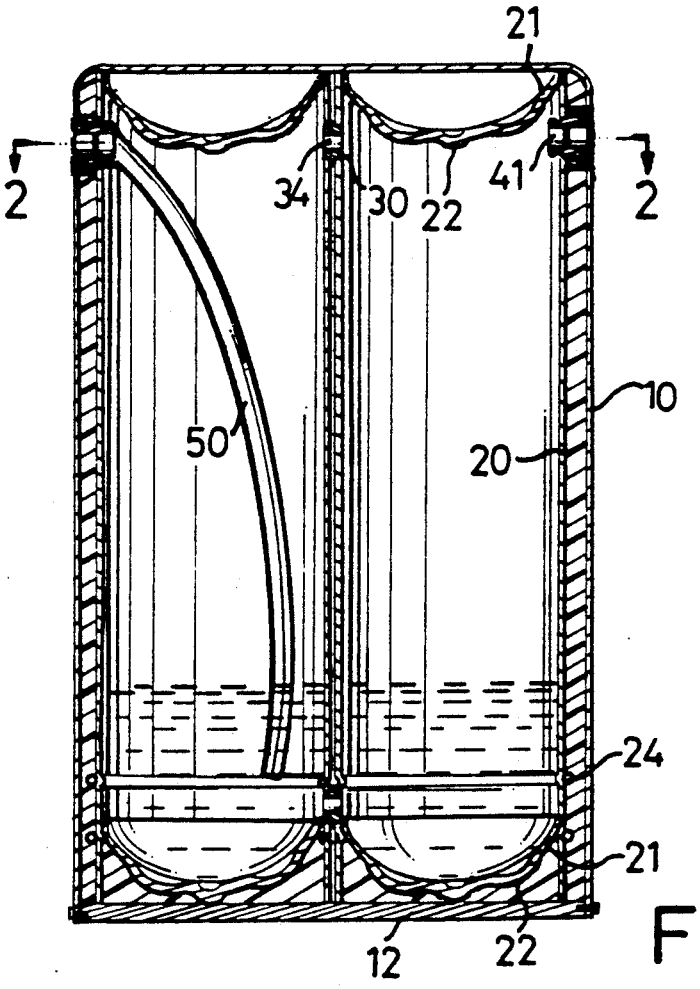
FIG. 3 is a cross sectional view taken along lines 3—3 of FIG. 2.

It is to be noted that, as shown in FIG. 3, the water contained in the barrel 20 at the right side will not be blended with the water contained in the barrel 20 at the left side in a fast speed, such that, normally, the water in the right barrel has a higher temperature than that of the water contained in the other barrel.

Accordingly, the container for the solar heater in accordance with the present invention includes at least one barrel received in the housing and well sealed such that the heat of the water contained within the barrels will not be easily radiated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim

1. A container for a solar heater comprising a housing, a pair of barrels received in said housing for containing liquid and each including an upper portion and a lower portion, a space formed between said housing and said barrels, a sealing material filled in said space, a coupler engaged in said upper portion of each of said barrels, a connector connected between said lower portions of said barrels, whereby, said liquid contained in said barrels may flow from one of the barrels to the other.

2. A container according to claim 1, wherein said housing includes an open bottom enclosed by a plate, said plate includes at least one orifice formed therein for injecting said foamable material into said space formed between said barrels and said housing.

3. A container according to claim 1, wherein each of said barrels includes a cap fixed in said upper portion and said lower portion respectively, each of said caps includes at least one protrusion formed thereon for reinforcing said caps.

4. A container according to claim 1, wherein each of said barrels includes at least one annular groove formed in said lower portion thereof, and said container further includes a clamping ring engaged with said annular grooves of said barrels so as to couple said barrels together.

5. A container according to claim 1, wherein said housing includes a pair of holes oppositely formed therein, said couplers are engaged with said holes respectively, each of said couplers includes at least one slot formed therein, and said container further includes a clamping ring engaged with said slots of said couplers so as to couple said barrels together.

* * * * *

UNITED STATES PATENT AND TRADEMARK OFFICE

CERTIFICATE OF CORRECTION

PATENT NO. : 5,285,921
DATED : February 15, 1994
INVENTOR(S) : Herman Lai

It is certified that error appears in the above-indentified patent and that said Letters Patent is hereby corrected as shown below:

TITLE PAGE

In the References cited, Col. 1, delete "4,527,542" and substitute therefor --4,527,543--.

In the References cited, Col. 2, delete "5,042,697" and substitute therefor --5,040,697--.

Col. 1, line 50, after "FIGS." insert --1--.

Signed and Sealed this

Twenty-third Day of August, 1994

*Attest:*

*Attesting Officer*

Bruce Lehman

BRUCE LEHMAN

*Commissioner of Patents and Trademarks*